US010580271B1

(12) United States Patent
Sanders et al.

(10) Patent No.: US 10,580,271 B1
(45) Date of Patent: Mar. 3, 2020

(54) WIRELESS SECURITY TRACKING FOR WEAPONS

(71) Applicant: Double Pull, Inc., Irving, TX (US)

(72) Inventors: David L. Sanders, Irving, TX (US); Raymon Bruce Sanders, Irving, TX (US)

(73) Assignee: Double Pull, Inc., Irving, TX (US)

( * ) Notice: Subject to any disclaimer, the term of this patent is extended or adjusted under 35 U.S.C. 154(b) by 0 days.

(21) Appl. No.: 16/100,488

(22) Filed: Aug. 10, 2018

Related U.S. Application Data

(60) Provisional application No. 62/543,873, filed on Aug. 10, 2017.

(51) Int. Cl.
*G08B 13/14* (2006.01)

(52) U.S. Cl.
CPC ..... *G08B 13/14* (2013.01)

(58) Field of Classification Search
CPC ..... G08B 1/00; G08B 13/14
USPC ..... 340/539.1, 539.11, 539.13, 573.1
See application file for complete search history.

(56) References Cited

U.S. PATENT DOCUMENTS

| | | | | |
|---|---|---|---|---|
| 6,226,913 | B1 * | 5/2001 | Haimovich | F41A 17/063 42/1.01 |
| 2004/0041724 | A1 * | 3/2004 | Levitan | F41H 13/00 342/22 |
| 2012/0131828 | A1 * | 5/2012 | August | F41A 19/01 42/1.02 |
| 2015/0077255 | A1 * | 3/2015 | Pallotta | F41A 17/063 340/572.1 |

* cited by examiner

*Primary Examiner* — Daryl C Pope

(57) ABSTRACT

An example method may include monitoring at least one tag enabled device, identifying a condition exists which requires a notification, notifying at least one registered device of the condition, responsive to a predetermined period of time lapsing, creating an emergency condition and notifying an emergency service provider.

10 Claims, 6 Drawing Sheets

200

400

WIRELESS SECURITY TRACKING FOR WEAPONS

TECHNICAL FIELD OF THE APPLICATION

This application relates to tracking weapons and more particularly to identifying weapon locations and when the weapons are moved from one location to another and/or used, via wireless tracking.

BACKGROUND OF THE APPLICATION

Conventionally, weapons, such as guns, knives, law enforcement equipment, and certain military devices are known to be dangerous. The safety measures include locks, latch mechanisms and other approaches to slowing down the unwarranted use and theft of such devices. However, the current capability to track the immediate location and/or the safe possession of a weapon or other dangerous device is limited.

The modern communication infrastructures, such as WIFI, BLUETOOTH, cellular, Internet-of-things (IoT) etc., provide protocols and mediums to identify any electronic device and in most cases its location. Weapons should also be tracked and updated continuously to ensure proper handling and to reduce the likelihood of illegal activity regarding the use of such weapons.

SUMMARY OF THE APPLICATION

Example embodiments of the present application provide at least a method that includes at least one of monitoring at least one tag enabled device, identifying a condition exists which requires a notification, notifying at least one registered device of the condition, responsive to a predetermined period of time lapsing, creating an emergency condition and notifying an emergency service provider.

DETAILED DESCRIPTION OF THE APPLICATION

It will be readily understood that the components of the present application, as generally described and illustrated in the figures herein, may be arranged and designed in a wide variety of different configurations. Thus, the following detailed description of the embodiments of a method, apparatus, and system, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In addition, while the term "message" has been used in the description of embodiments of the present application, the application may be applied to many types of network data, such as, packet, frame, datagram, etc. For purposes of this application, the term "message" also includes packet, frame, datagram, and any equivalents thereof. Furthermore, while certain types of messages and signaling are depicted in exemplary embodiments of the application, the application is not limited to a certain type of message, and the application is not limited to a certain type of signaling.

Figure 1:
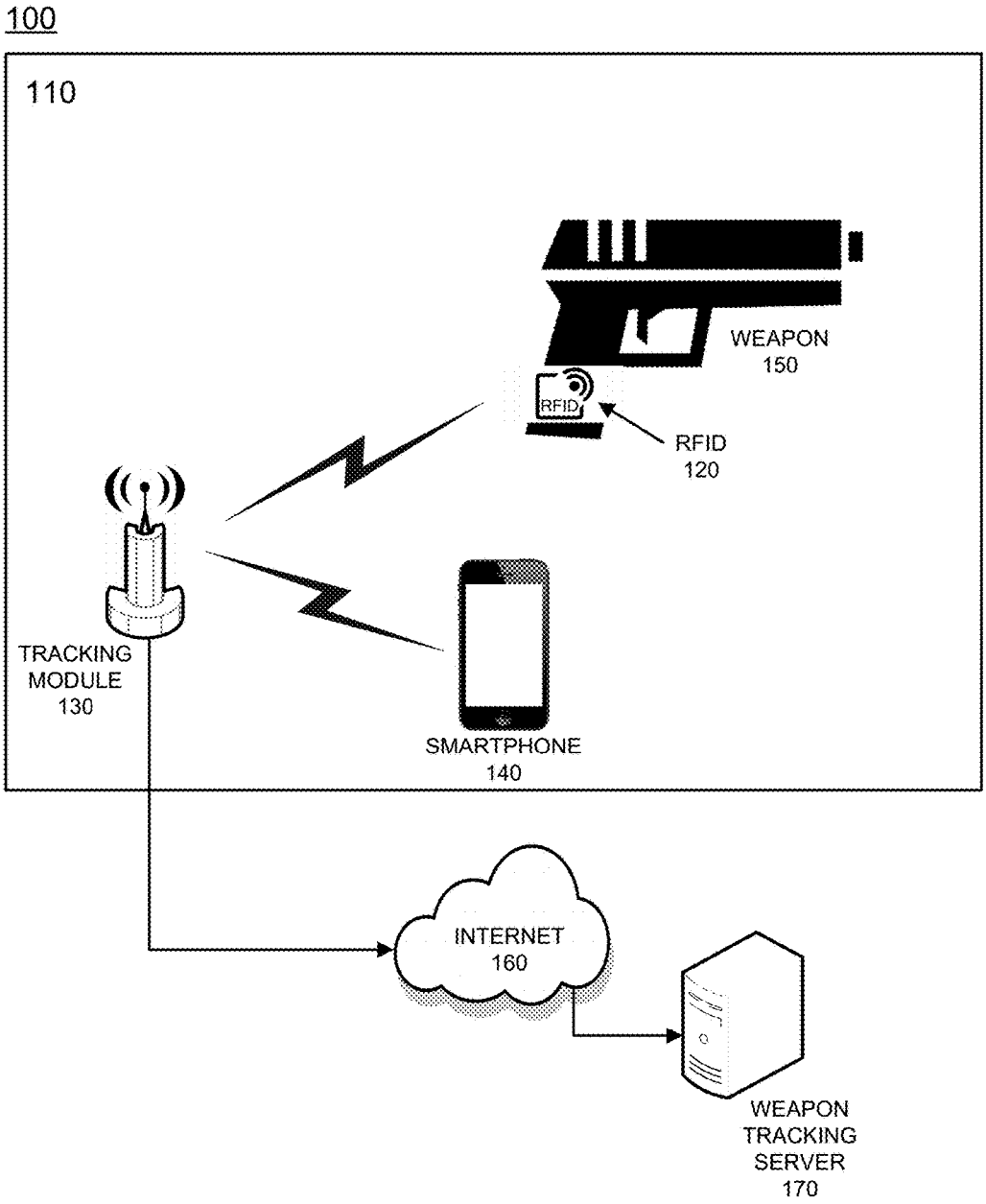
FIG. 1 illustrates an example network configuration for monitoring and maintaining updated weapon status information according to example embodiments.

FIG. 1 illustrates an example network configuration for monitoring and maintaining updated weapon status information according to example embodiments. Referring to FIG. 1, the system configuration 100 depicts a weapon stored in the user's home vicinity 110. In this example, the weapon 150 is paired with a RFID tag 120 which may be a sticker or other small device which is affixed to the weapon 150 and which provides a continuous transmission, such as a beacon signal which can be detected by a tracking module 130 located inside the home. Also, a user's smartphone 140 may be updated with location status information from the tracking module 130, or, in an alternative embodiment may be the actual tracking module complete with RFID tracking capabilities. The RFID tag 120 may be a passive or an active tag, however, for purposes of this example, the tag 120 will be passive as it is merely being identified by the tracking module 130 and not performing other advanced RFID features.

In operation, the tracking module 130 periodically checks for the presence of all such weapons 150 which are labeled with tags 120. An application operating on the user's device 140 may be updated as well to indicate the current weapon status information of all registered weapons which are also being tracked with RFID tags. The tracking module may be BLUETOOTH and/or WIFI compatible to communicate with a home router or Internet modem, which can be used as a repeater for communicating with the Internet 160, a server 170 used to track the information and/or the user device 140 to update the current weapon location status information and/or usage information.

According to one example embodiment, the wireless communication/tracking module 130 may be configured to detect the presence of any tagged devices. For example, various devices, such as weapons may be fitted with a radio tag, such as a radio frequency identification (RFID) tag or other wireless communication emitter device. The ultra-high frequency (UHF) RFID tags may be registered to a master server used for tracking 170. In one example, upon an unauthorized removal of a weapon having the RFID tag from range of the module RFID antenna, the module 130 may communicate via a GSM network with a user's smartphone 140 to notify of the emergency event.

Figure 2:
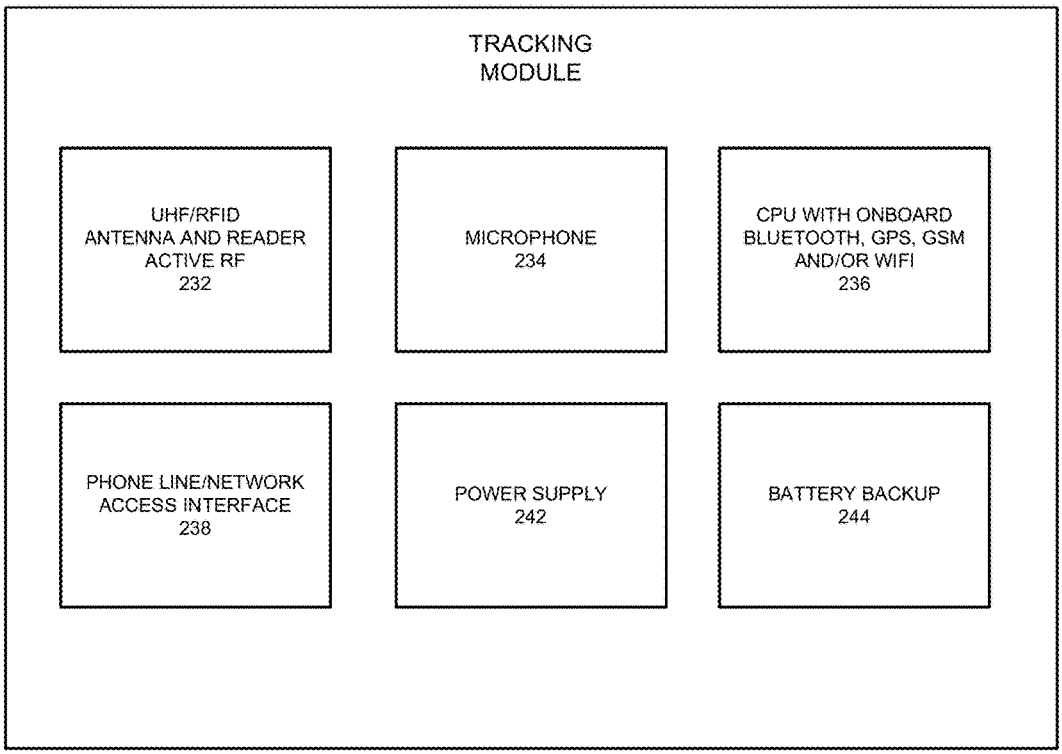
FIG. 2 illustrates an example tracking module used to continuously monitor the status of the weapons being tracked according to example embodiments.

FIG. 2 illustrates an example tracking module used to continuously monitor the status of the weapons being tracked according to example embodiments. Referring to FIG. 2, the module 130 may have customizable features which can be modified using an application on the smartphone 140. In general, the module 200 includes an onboard microphone 234, which can detect gunfire sounds and depending on user preference may communicate with nearby emergency services and/or the user device. The module 230 may also have a UHF/RFID antenna and reader 232 to provide active RFID services, a CPU with BLUETOOTH and/or GPS and/or GSM and/or SIM CARD and/or WIFI compatible circuitry 236 for communicating with the user's device, in-home routers, other wireless devices, etc. The module may also have a network and/or telephone interface 238 to communicate with an emergency call center, a power supply 242 and/or a battery 244, in the event of a power outage.

In one example, the module may be compatible with popular voice recognition devices, such as APPLE's SIRI, AMAZON'S ALEXA, MICROSOFT'S CORTANA, etc. That way a user can interface with the module to correct errors or make exceptions. For example, if the user is seeking to remove his or her shotgun from the house, which is actively being monitored, the user can talk to the module voice recognition interface to ensure the removal of the weapon by name and/or ID number. The module may recognize the user's voice frequency as a security measure or require the password be spoken to validate the weapon removal for an 8 hour trip, 2 day trip, one week trip, etc. Also, if the user is deciding to shoot the weapon outside at a target, the microphone 234 may cause the module to send an alert to the user's smartphone, in which case the user can simply enter the home and speak to the voice recognition unit and alleviate the concern and avoid having the authorities called after a predetermined amount of time due to failure to respond to the emergency event condition (i.e., loud gunfire).

In general, the module 230 can detect the presence of the UHF RFID tags registered as lost or stolen and notify module user or police (dependent on user preference). The module can be switched off for a set time for removal of user weapons or overridden by command. The module may also be made available for public use where weapons are prohibited (i.e., schools, post office etc.). Also, such device can continuously monitor and read all UHF RFID tags which are identified to automatically notify authorities when any weapon is identified as being nearby. Upon receiving a "weapon stolen" notification on the user's smartphone, an owner can opt a tag number as stolen or missing, or not stolen or missing and override the alert. The monitoring modules can also be installed in police and public vehicles to scan for weapons registered as missing or stolen.

In one example, an owner on a vacation may have set an application to fully monitor for devices in "vacation" mode. Thieves may have stolen weapons throughout the user's living area neighborhood, and one weapon may include an ID chip. The user device cannot receive notifications from the application at a particular time because the user is on an airplane. The user of the previously stolen weapon may have already received a notification and marked the weapon as stolen. In this example, the "vacation mode" may provide permission to notify authorities and the thieves can be caught in the act of attempting to remove the weapon from the proximity of the in-home module.

In another example, an owner may forget to deactivate his/her module for weapon removal purposes, the owner receives a notification from the application on his or her smartphone that the weapon has been removed. In this example, the owner may simply input a password or select the option to indicate to the module that the weapon has been removed by the user. This incident is logged locally on a user's smartphone in case a user made a mistake and needs to change the selection previously selected.

In another example, an owner's young-adult child may have suffered a mental breakdown and decides to take the parents' weapon to school. In this event, the owner is notified via the smartphone update, when the weapon leaves the home and a separate module at the school detects when the weapon comes nearby. Now, the police and the owner are notified of not only the removal but the detection, which could trigger another emergency event with greater severity. The owner could then notify the police and the school automatically without any action being needed.

In another example, the weapon owner may be a victim of an armed robbery in his/her home. The owner uses a code word to automatically notify police using either the module or a separate smart home device attached to the module. The robbers may fire their weapons and the module makes emergency services aware there are shots fired automatically via the microphone noise detection. This can also provide a survivor link system to automatically notify all nearby officers of shots fired. In this example, the emergency notification may access a user record to retrieve a user photograph and pair the alert with the photograph so the authorities may recognize the rightful weapon owner as opposed to a third party upon arrival to the user's home.

Figure 3:
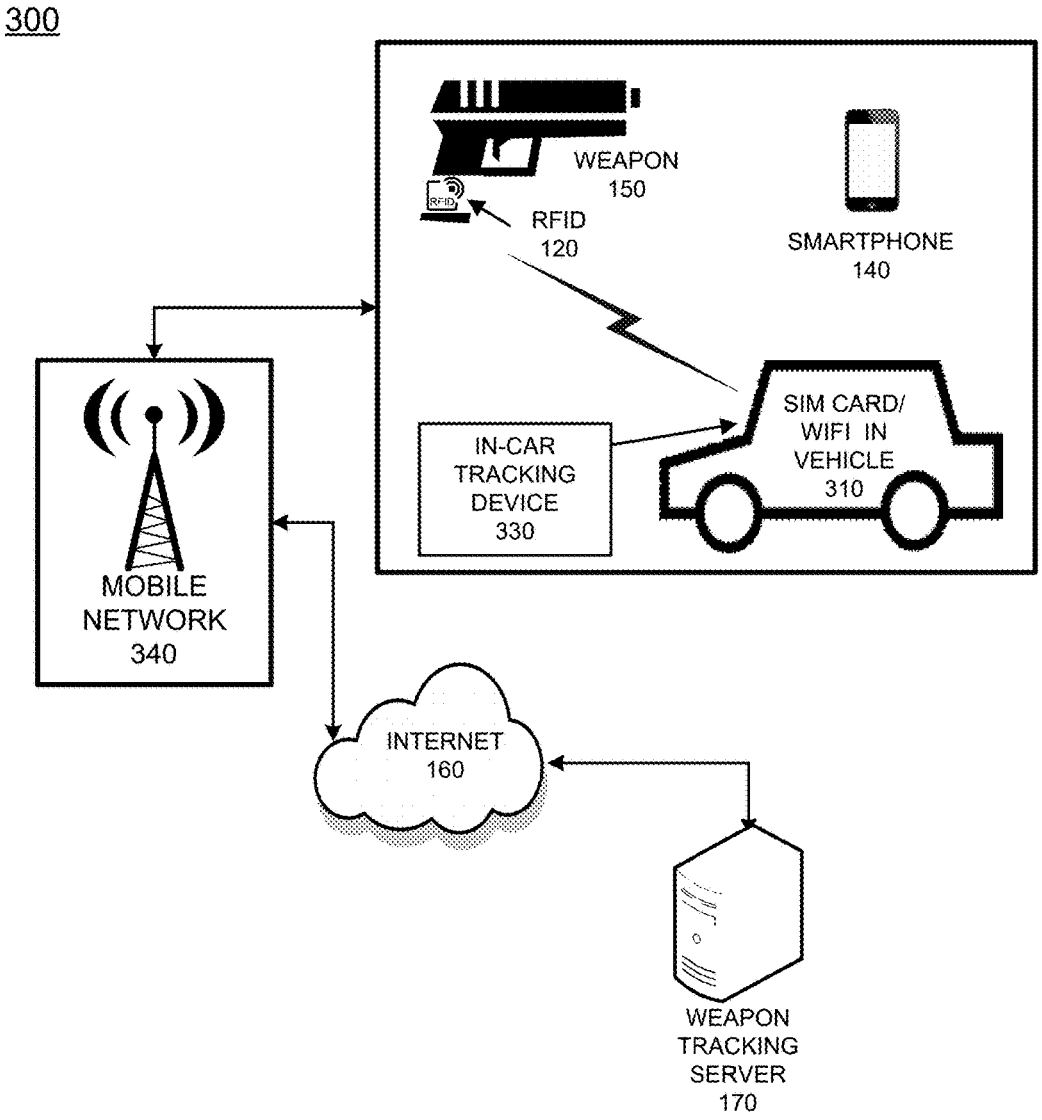
FIG. 3 illustrates a network configuration of a motor vehicle being used as a site for weapon tracking according to example embodiments.

FIG. 3 illustrates a network configuration of a motor vehicle being used as a site for weapon tracking according to example embodiments. Referring to FIG. 3, the network configuration 300 is similar to the in-home network of FIG. 1, however, the tracking device or monitoring module 330 is now located in the vehicle 310, which may be equipped with a SIM card or other communication instrument to report a missing weapon 120 which has been removed from the vehicle. A motor vehicle may be known safe place and common place to store weapons, whether they be for a military vehicle, a police vehicle, a government agency vehicle, or a personal vehicle. In operation, the removal of the weapon from the vehicle may cause an alarm condition when the antenna of the tracking device 330 detects loss of signal from the weapon 150 and its RFID tag 120. A user's smartphone 140 may be informed about the condition. Also, the SIM card in the tracking device and/or vehicle may call to a cellular station 340 to update the weapon tracking server 170 about the weapon loss condition.

Figure 4:
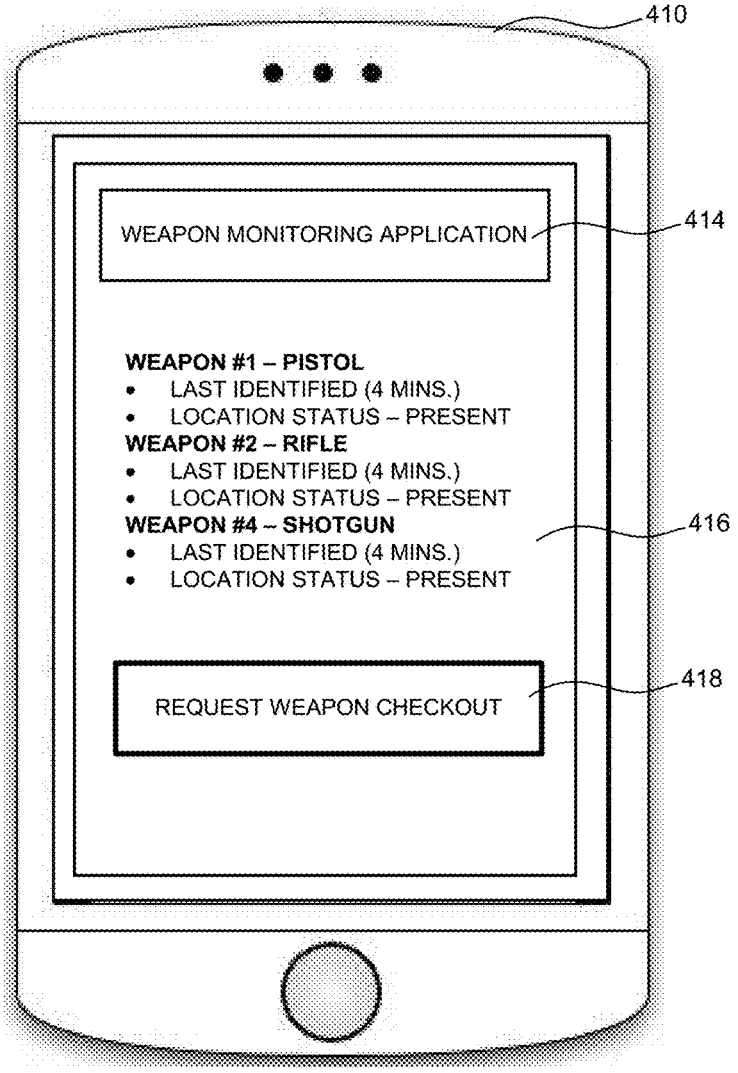
FIG. 4 illustrates a graphical user interface of a user device receiving updated weapon location status information according to example embodiments.

FIG. 4 illustrates a graphical user interface of a user device receiving updated weapon location status information, according to example embodiments. Referring to FIG. 4, the user interface example 400 includes a smartphone device 410, and a customized application 414 which provides an inventory 416 of all nearby weapons detected via the wireless communication monitoring of the monitoring device and the RFID tagged weapons. The updates are pushed to the user device. In the event that the user desires to legitimately remove a weapon from vicinity of the monitoring device, the application provides an option 418 to properly avoid alerts or emergency actions taken in the event of the weapon's removal. The removal may further provide additional options, such as length of removal and/or purpose of removal, all of which can be logged for future reference and which can automatically re-enable the security features after a certain period of time has lapsed.

The application may also have a password protection feature for user security. The user may have ability to select which functions to use and not use. Functions may include a stolen weapon notification, an unrecognized weapon proximity notification, a stolen weapon reporting notification, and a notification if gunfire is detected. The user may have option on whether or not to report missing/stolen weapons to law enforcement. In this example, the user may mark registered weapons as missing which are then automatically added to a list of "stolen" weapons, and users with stolen weapons in their vicinity are notified accordingly. An automatic emergency services notification for a stolen weapon may also be optional.

Other features include the application warning the user device in the case of impending module failure, the application also includes a multiple preset and customizable "mode" for example, "vacation mode", application which permits the user to set times or simply notify the module when the user desires to remove and carry his/her gun out of the module monitored area.

Figure 5:
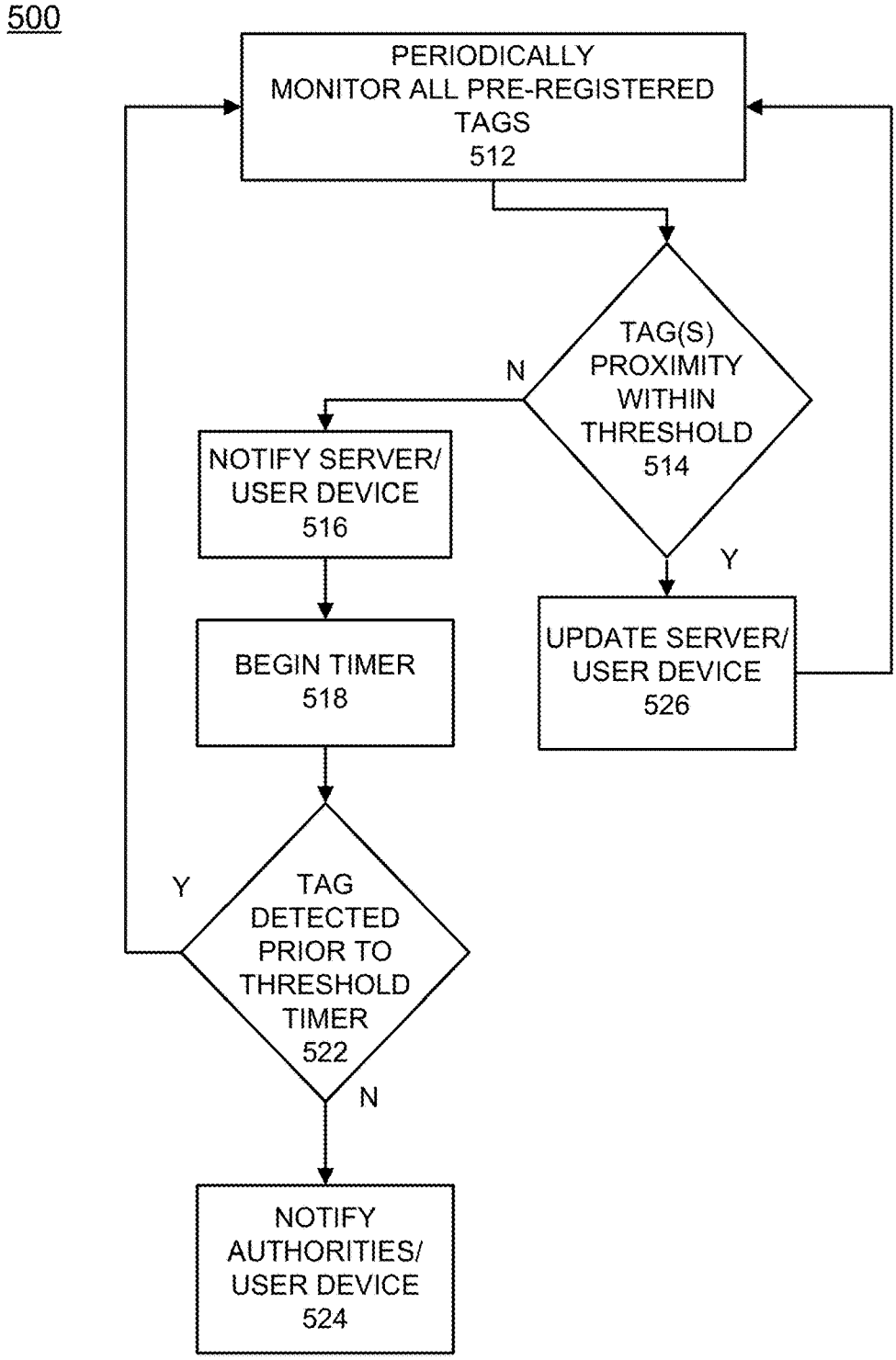
FIG. 5 illustrates a logic flow diagram of an example method of operation of the module detection unit according to example embodiments.

FIG. 5 illustrates a logic flow diagram of an example method of operation of the module detection unit according to example embodiments. Referring to FIG. 5, the method 500 may provide the monitoring device periodically monitoring all pre-registered tags on all devices being monitored 512. Then, in the event that a known tag is moved and identified as not in the proximity 514 the server and/or user device is notified 516 by a message or alert. A timer is begun 518 to count a certain threshold time 522 prior to issuing an emergency alert, such as calling the police 524, etc. Otherwise, if the condition is fixed, the monitoring continues 512. If the tag is within the threshold 514, the server may also be updated with a positive condition 526 indicating there are no problems regarding the weapon's location.

The operations of a method or algorithm described in connection with the embodiments disclosed herein may be embodied directly in hardware, in a computer program executed by a processor, or in a combination of the two. A computer program may be embodied on a computer readable medium, such as a storage medium. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

An exemplary storage medium may be coupled to the processor such that the processor may read information from, and write information to, the storage medium. In the alternative, the storage medium may be integral to the processor. The processor and the storage medium may reside in an application specific integrated circuit ("ASIC"). In the alternative, the processor and the storage medium may reside as discrete components. For example, FIG. 6 illustrates an example network element 600, which may represent any of the above-described network components of the other figures.

Figure 6:
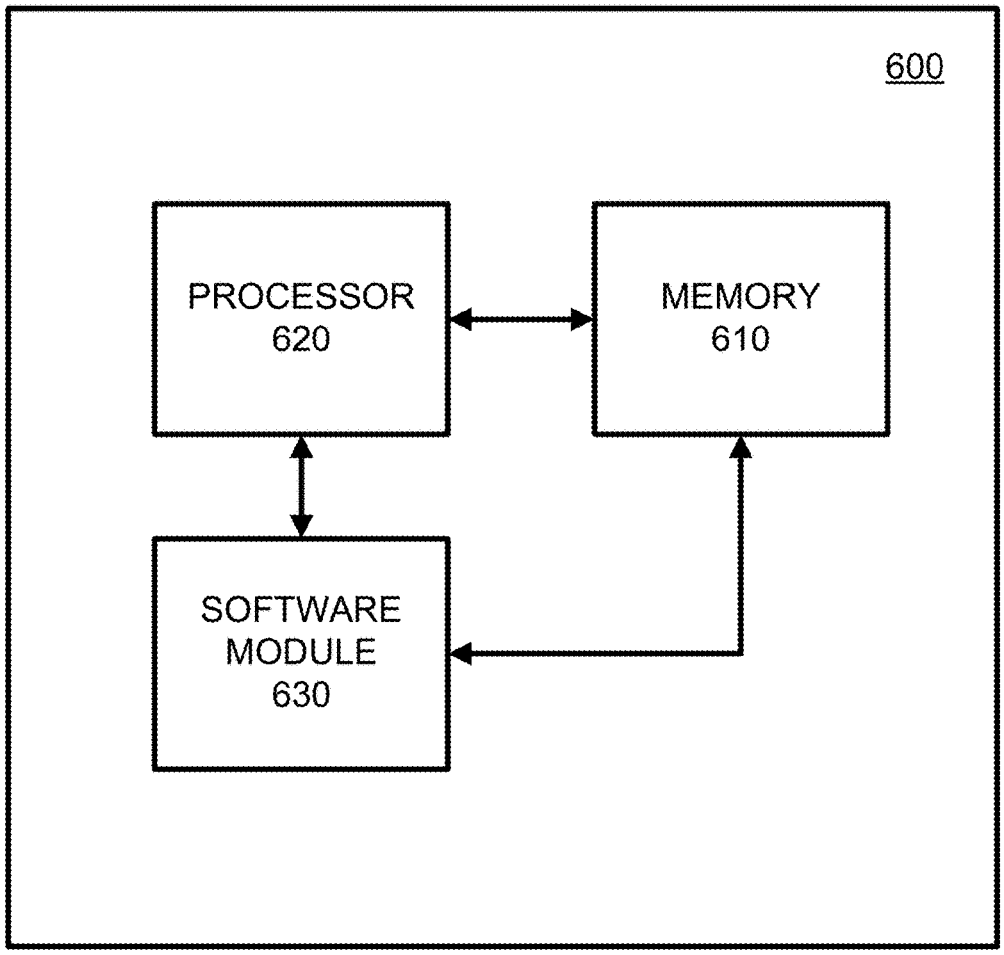
FIG. 6 illustrates an example network entity device configured to store instructions, software, and corresponding hardware for executing the same, according to example embodiments of the present application.

As illustrated in FIG. 6, a memory 610 and a processor 620 may be discrete components of the network entity 600 that are used to execute an application or set of operations. The application may be coded in software in a computer language understood by the processor 620, and stored in a computer readable medium, such as, the memory 610. The computer readable medium may be a non-transitory computer readable medium that includes tangible hardware components in addition to software stored in memory. Furthermore, a software module 630 may be another discrete entity that is part of the network entity 600, and which contains software instructions that may be executed by the processor 620. In addition to the above noted components of the network entity 600, the network entity 600 may also have a transmitter and receiver pair configured to receive and transmit communication signals (not shown).

Although an exemplary embodiment of the system, method, and computer readable medium of the present application has been illustrated in the accompanied drawings and described in the foregoing detailed description, it will be understood that the application is not limited to the embodiments disclosed, but is capable of numerous rearrangements, modifications, and substitutions without departing from the spirit or scope of the application as set forth and defined by the following claims. For example, the capabilities of the system of the various figures can be performed by one or more of the modules or components described herein or in a distributed architecture and may include a transmitter, receiver or pair of both. For example, all or part of the functionality performed by the individual modules, may be performed by one or more of these modules. Further, the functionality described herein may be performed at various times and in relation to various events, internal or external to the modules or components. Also, the information sent between various modules can be sent between the modules via at least one of: a data network, the Internet, a voice network, an Internet Protocol network, a wireless device, a wired device and/or via plurality of protocols. Also, the messages sent or received by any of the modules may be sent or received directly and/or via one or more of the other modules.

One skilled in the art will appreciate that a "system" could be embodied as a personal computer, a server, a console, a personal digital assistant (PDA), a cell phone, a tablet computing device, a smartphone or any other suitable computing device, or combination of devices. Presenting the above-described functions as being performed by a "system" is not intended to limit the scope of the present application in any way, but is intended to provide one example of many embodiments of the present application. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

One having ordinary skill in the art will readily understand that the application as discussed above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

While preferred embodiments of the present application have been described, it is to be understood that the embodiments described are illustrative only and the scope of the application is to be defined solely by the appended claims when considered with a full range of equivalents and modifications (e.g., protocols, hardware devices, software platforms etc.) thereto.

What is claimed is:

1. A method comprising:

monitoring, via a tracking module, a location of at least one tag enabled device relative to the tracking module;

generating, via the tracking module, a notification indicating that a location of the at least one tag enable device has exceeded a certain distance from the tracking module;

transmitting, via the tracking module, the notification to at least one registered device;

initiating, via the tracking module, a timer to identify a period of time that the at least one tag enabled device exceeds the certain distance; and transmitting, via the tracking module, an emergency notification to an emergency service provider if the identified period of time exceeds a predetermined time period.

2. The method of claim 1, further comprising:

receiving, via the tracking module, a verbal authorization from a user; and deactivating, via the tracking module, generation of an emergency notification based on the verbal authorization.

3. The method of claim 1, further comprising:

detecting, via the tracking module, a sound generated by the at least one tag enabled device;

initiating, via the tracking module, the timer to identify a period of time following the detection of the sound; and transmitting, via the tracking module, the emergency notification to the emergency service provider if the identified period of time exceeds a predetermined time period.

4. The method of claim 1, further comprising:

detecting, via the tracking module, a sound generated by the at least one tag enabled device;

automatically transmitting, via the tracking module, the emergency notification to the emergency service provider based on the detecting.

5. The method of claim 4, further comprising:

automatically transmitting, via the tracking module, an image identifying an owner of the at least one tag enabled device to the emergency service provider.

6. The method of claim 1, further comprising:

receiving, via the tracking module, a message from the at least one registered device indicating a status of the at least one tag enabled device in response to the notification.

7. An apparatus, comprising:

a processor; and a memory to store at least one instruction that when executed by the processor causes the processor to:

receive a notification from a tracking module that monitors a location of an RFID tag, affixed to a weapon, relative to the tracking module, the notification indicating that the RFID tag has exceeded a certain distance from the tracking module; and receive an emergency notification from the tracking module if the tracking module identifies that a period of time that the RFID tag exceeds the certain distance is greater than a predetermined time period.

8. The apparatus of claim 7, wherein the memory further stores at least one instruction that that when executed by the processor causes the processor to:

identify a status of the weapon in response to the notification.

9. The apparatus of claim 8, wherein, when the processor identifies the weapon as not stolen, the processor further is to override the notification.

10. The apparatus of claim 7, wherein the apparatus further includes a display; and wherein the memory further stores at least one instruction that that when executed by the processor causes the processor to:

receive, via the display, an input from a user of the apparatus requesting suspension of notifications to the apparatus.

* * * * *